United States Patent [19]

Goldfarb et al.

[11] Patent Number: 5,009,431

[45] Date of Patent: Apr. 23, 1991

[54] SURPRISE ACTION GAME

[75] Inventors: Adolph E. Goldfarb, 1432 S. Eastwind Cir., Westlake Village, Calif. 91361; Martin I. Goldfarb, Santa Monica, Calif.

[73] Assignee: Adolph E. Goldfarb, Westlake Village, Calif.

[21] Appl. No.: 477,637

[22] Filed: Feb. 9, 1990

[51] Int. Cl.[5] ..... A63F 3/00

[52] U.S. Cl. ..... 273/258; 273/440

[58] Field of Search ..... 273/1 G, 1 GC, 1 GE, 273/138 R, 138 A, 258; 446/310

[56] References Cited

U.S. PATENT DOCUMENTS

| | | | |
|---|---|---|---|
| 2,794,643 | 6/1957 | Lafleur | 273/138 R |
| 3,594,000 | 7/1971 | Glass et al. | 273/1 GE X |
| 3,797,831 | 3/1974 | Glass et al. | 273/138 R |
| 3,861,686 | 1/1975 | Breslow et al. | 273/138 R |
| 4,206,925 | 6/1980 | Goldfarb et al. | 273/138 R |

*Primary Examiner*—Paul E. Shapiro

*Attorney, Agent, or Firm*—Ashen Martin Seldon Lippman & Scillieri

[57] ABSTRACT

A multiplayer surprise action game in the form of a central unit which defines a spiral pathway around its upper portion and a housing for an object-projecting mechanism in its lower portion. The housing has a plurality of openable doorways spaced around it. Each doorway defines a player station. The mechanism is randomly rotated to aim at only one of the doorways at any time, while concealing from the players the doorway at which it is aimed. The players move play pieces along the pathway and manipulate an advancing mechanisn that unpredictably sets off a noise maker after an apparently random time. The players have a chance to prepare, and then they activate the projecting mechanism. The mechanism projects the object (such as a toy snake) outwardly through the doorway at which it is then aimed, to the surprise of and excitement of the players. The particular player station/doorway from which the snake emerges may be used by the players to adjust the further play of the game.

16 Claims, 6 Drawing Sheets

SURPRISE ACTION GAME

BACKGROUND OF INVENTION

Games and devices that provide action on a random or "surprise" basis have always been popular with players, especially young children.

Often the "randomness" is transparent, even to younger children. In other words, they can, in some way, see and/or foretell when the action will occur. While they still may be excited, it is much preferred if they are really surprised by the randomness.

Further, the action in many such devices just happened. There is inadequate build-up to provide the desired anticipation.

Also such devices, particularly with modern electronics have become very complex, sophisticated, and thus costly and susceptible to malfunction.

SUMMARY OF DISCLOSURE

The illustrated game apparatus effectively protects its "randomness" from the eyes of the users. It builds suspense, anticipation and tension by operating at a stepped pace that even younger players can control.

More particularly, a central unit houses a randomly aimed object-projecting mechanism. The aim of the mechanism is easily reset after each action, but it is totally concealed from the players until the next action occurs. The players sit around the unit, each facing his or her doorway from which the object—such as a toy rattlesnake—may leap.

As they play the game, as by advancing their player pieces, they also manually incrementally keep advancing a mechanism that advances a hidden mechanical timer and sound maker. The timer/sound maker starts from a different hidden position after each action, so the amount of movement needed to set off the noise maker is unknown and different each time.

At some point the noise maker sounds: e.g., the "rattle" of a rattlesnake! All hearts skip a beat. Who is the snake pointed at? Time to stop, think and worry. Each player can move their piece backward to a "safe" spot, or take their chance where they are.

Only after the agonizing and worried decision is the "snake" manually released. It pops out of one of the doorways. Relief or "oh shucks!", and the play resumes. Reset the hidden projectile to aim randomly at a doorway, more play of the game, the "rattle" sound, the agonizing choices again, and so on until someone reaches the top of the mountain.

IN THE DRAWINGS

DETAILS OF THE DRAWINGS

Figure 1:
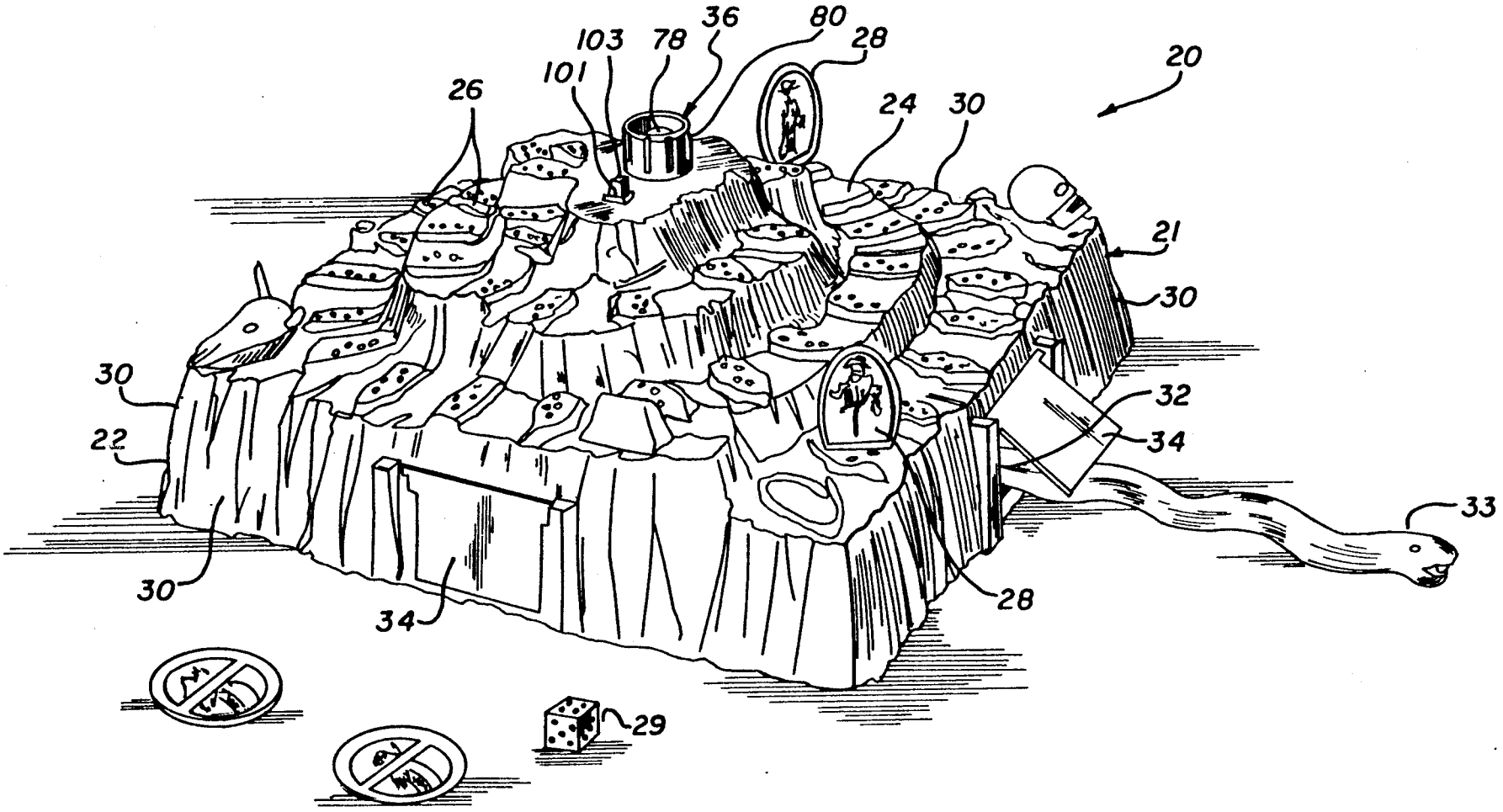
FIG. 1 is a perspective view of a game apparatus comprising a presently preferred embodiment of the invention.

As shown in FIG. 1, the illustrated apparatus 20 comprises generally a central mechanical unit in the form of a housing 21 that has a lower section 22 that serves as a base and a upper section 24 that defines an external spiral pathway 26. A play piece 28 is assigned to each player to move along the pathway.

Figure 2A:
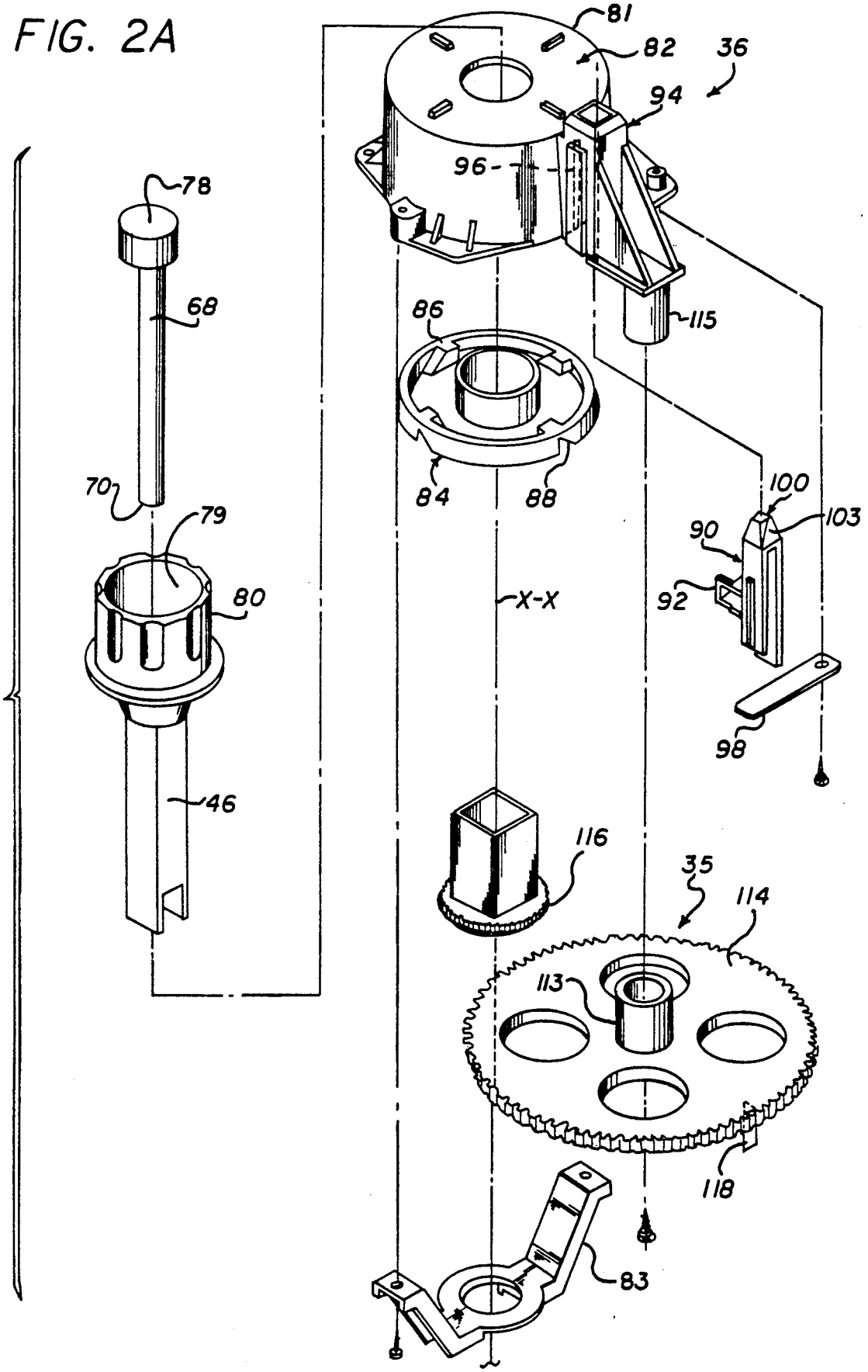
FIG. 2A is an enlarged exploded perspective view of upper interior portions of the apparatus.
Figure 2B:
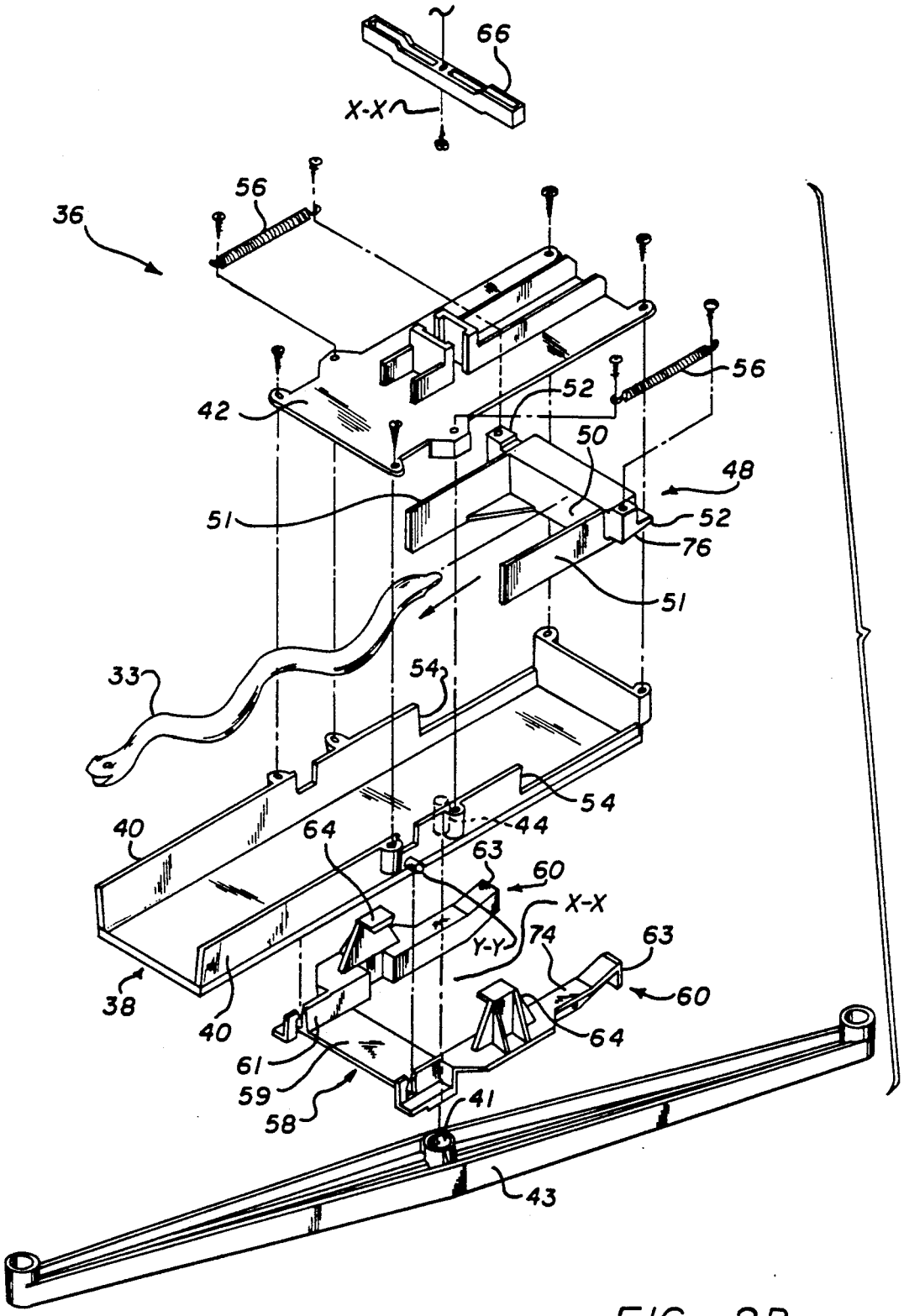
FIG. 2B is an enlarged exploded perspective view of lower interior portions of the apparatus.
Figure 3:
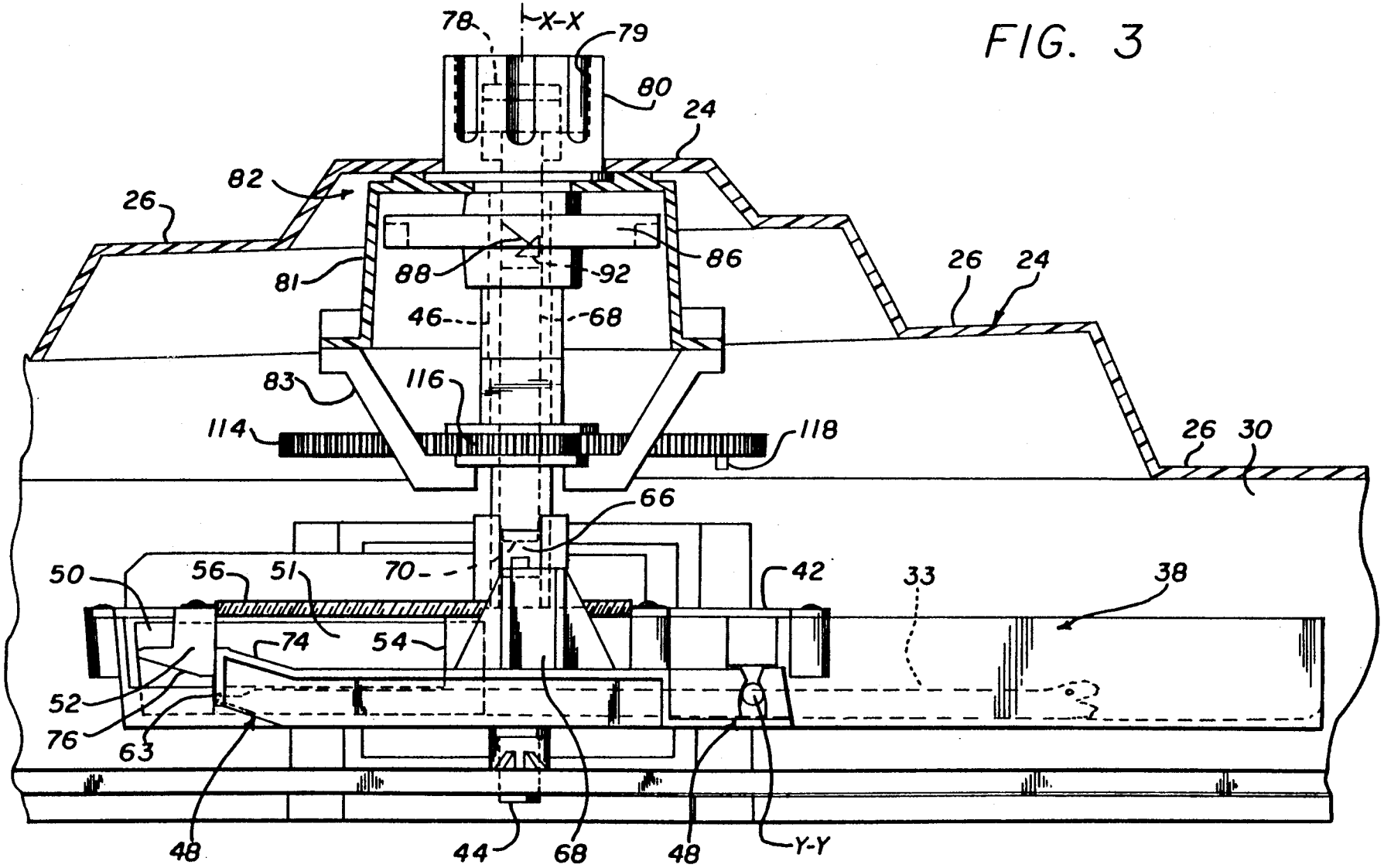
FIG. 3 is an enlarged partial transverse sectional view of the apparatus, showing the object propelling mechanism in the cocked or loaded condition.
Figure 4:
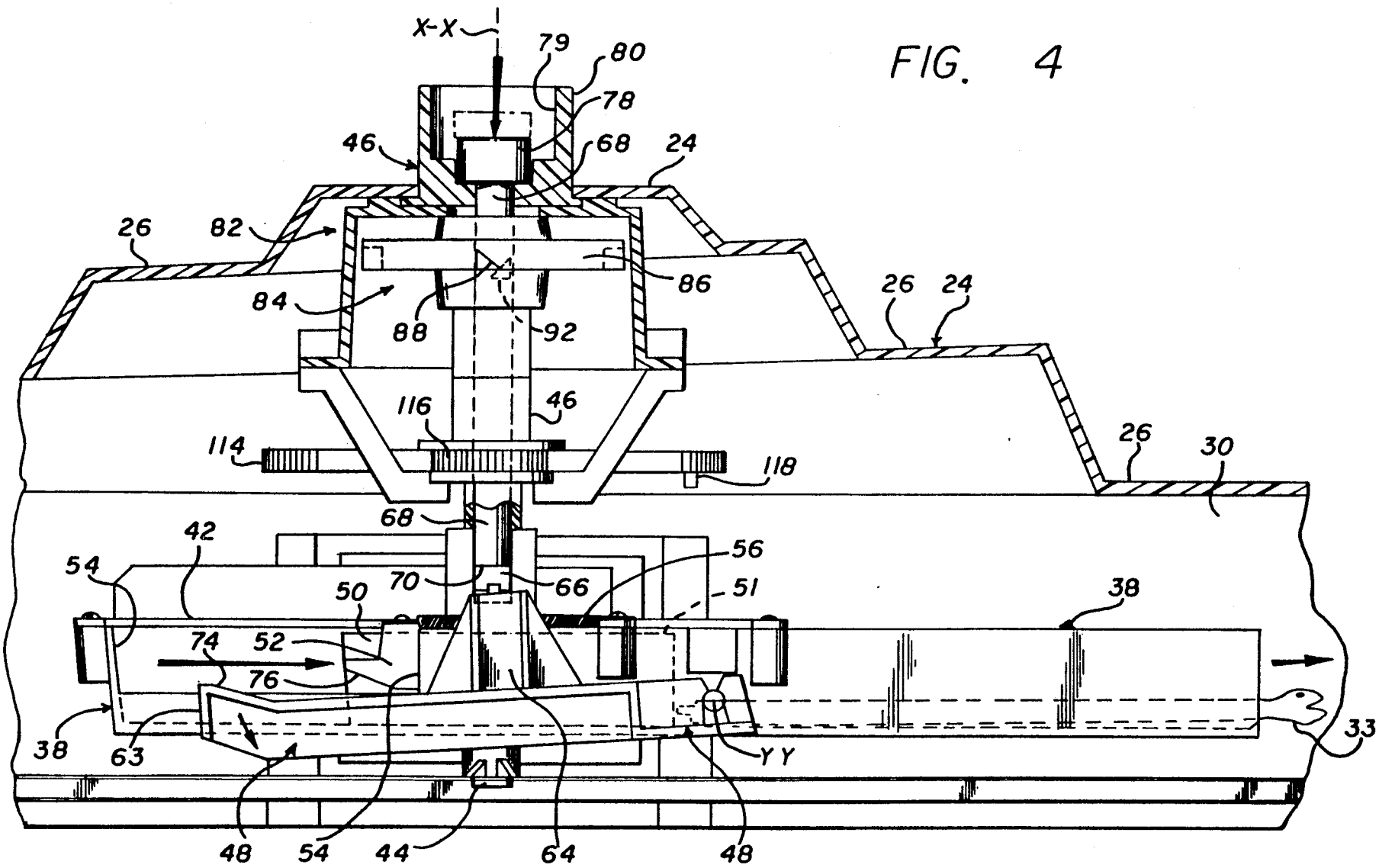
FIG. 4 is a view similar to FIG. 3, showing the object-propelling mechanism in the forwardly projecting condition.

The illustrated base section 22 is generally rectangular, providing at each of its four sides 30 a player position defined by an openable doorway 32. A positionable projecting mechanism 36 within the housing (FIGS. 2A and 2B) is movable so as to aim at any one of the player doorways 32, and when actuated, to propel an object such as a toy rattlesnake 33 outwardly through the doorway (FIGS. 3 and 4). The mechanism is 36 operable to randomly position the projector to aim at one of the doorways at any one time without revealing its position to the players.

Figure 5:
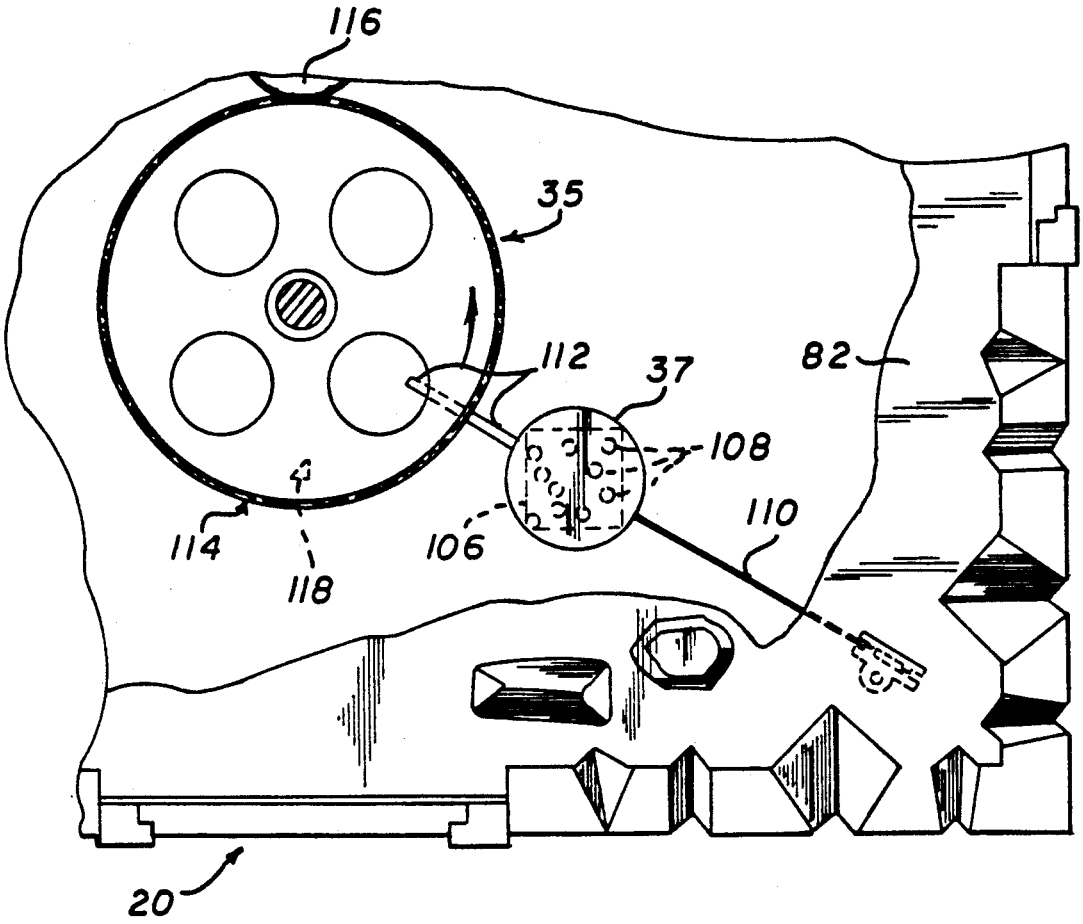
FIG. 5 is a fragmentary enlarged cutaway top plan view showing the sound-making mechanism of the apparatus.
Figure 6:
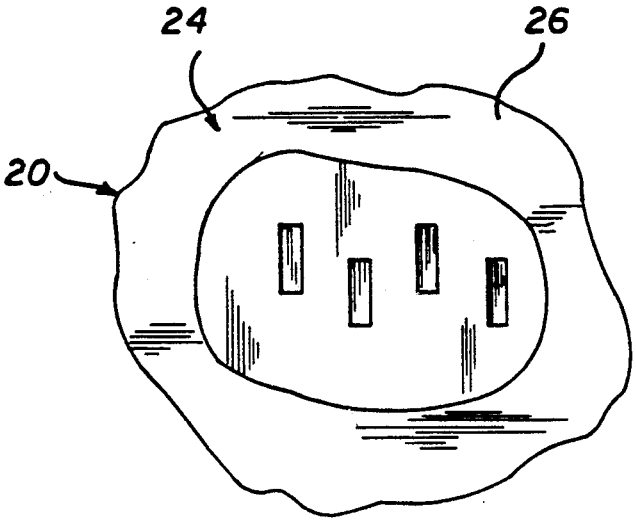
FIG. 6 is a further enlarged top plan view of one station along the pathway.

As shown in FIG. 5, there is a timing mechanism 35 which, in the illustrated embodiment, is mechanically advanced by player manipulation until it apparently randomly actuates a sound maker 37, such as one that simulates the "rattle" sound of a rattlesnake.

Further, in the illustrated apparatus, the projecting mechanism 36 may be manually released at the desired time to project the rattlesnake through the doorway at which it is aimed, to the surprise and excitement of the players. (FIG. 1)

The projecting mechanism 36 is then reset and apparently randomly positioned. Then a new time cycle begins. In the play of the game, the emergence of the toy snake from player's doorway 32 may have a specified affect on that player's position in the game, such as requiring a penalty or rearward movement of that player's play piece on the spiral path.

Now to consider the illustrated apparatus in further detail.

It will be noted initially that the illustrated apparatus is totally mechanical and does not rely on any electricity or electronic elements. Such construction provides a simple, relatively inexpensive, durable and reliable toy product, particularly for use by younger children.

The housing 21 of the illustrated apparatus 20 may be made of molded plastic or other suitable material. Referring to FIG. 1, the upper section 24 is in the shape of a mountain having a spiral pathway 26 which extends around from bottom to top of the mountain. The pathway 27 may comprise a series of positions or stops. Small openings or receptacles 25 may be provided at each position to receive small mating pins on the bottoms of the play pieces (not shown). Each player may have a distinctive (as by being a different color) play piece 28, which moves from position to position along the pathway. The movement may be defined by any usual means such as dice or a spinner 29 as shown in FIG. 1.

Still referring to FIG. 1, the lower housing section 22 is generally rectangular with four generally equal outwardly facing sidewalls 30. Each side wall 30 has, generally in its center, a generally rectangular opening or doorway 32 in which a door 34 is mounted. Each doorway and door provides a player position for one of the players. The illustrated doors are each hingedly mounted at their upper edge to hang downwardly in the associated doorway. The doorways and doors are proportioned so that the door substantially occupies the doorway and conceals from the players the interior of the housing. The doors will tend to assume this closed position by virtue of gravity on the hinged doors. When the projecting means is fired at a doorway, the object simply engages the associate door and swings it out of the way so that the toy rattlesnake object can emerge through the doorway.

The projection means or mechanism 36 is mounted within the housing section 22 and is movable, as noted above, so that it can aim at any of the four doorways. More particularly, the projection mechanism 36, as shown in exploded perspective in FIGS. 2A and 2B, includes a horizontal elongated platform 38 that has a pair of upright opposed side rails 40. The platform 38 is a generally rectangular plate-like member. The platform 38 is pivotally mounted for rotation about a vertically extending central axis x—x of the unit. The platform 38 is mounted at about the level of the doorways 32 to facilitate the projected rattlesnake passing through the doorway at which the mechanism is aimed. The platform is provided with a cover plate 42 to form a platform assembly. The cover plate 42 may be secured to the platform 38 as by screws. In this way the vertical shaft structure which mounts the platform for rotation about the central vertical axis x—x does not interfere with physical movement of the projected object along the platform. More particularly, a lower shaft portion or pin 44 is fixed for common rotation to the underside of the platform 38. An upper shaft portion 46 is secured to the top surface of the platform cover 42. These shaft portions 44 and 46 are mounted in the apparatus housing 21 in suitable bearing portions to allow the shaft portions (and the platform) to rotate around the central vertical axis. More particularly, the lower shaft portion pin 44 is rotatably received in a bearing 41 in a frame crosspiece 43.

The projection means 36 also includes a slider or launcher member 48 which is disposed upon the platform 38 for longitudinal movement therealong. The slider 48 includes a pair of opposed upright side walls 51, and a rear transversely extending pusher wall 50. The pusher wall 50 engages the toy snake piece 33 and moves it along with the slider member. The slider member 48 is biased for movement in the forward direction as indicated by the arrows in FIGS. 2B and 4. More particularly, the slider member 48 includes a pair of ears 52 that extend outwardly from the side walls 51. The ears 52 extend outwardly, respectively, through longitudinal horizontally extending slots 54 in the side rails 40 of the platform 38. The ears 52 may be connected to suitable springs 56 to bias the slider member in the forward direction.

Also mounted on the platform assembly is a release or latch member 58. The latch member 58 has a horizontal transverse plate portion 59 disposed below the platform assembly, and a pair of spaced-apart longitudinally rearwardly extending arms 60. The arms 60 are mounted on upward extensions 61 attached to the side edges of the transverse plate at either side of the platform assembly. As shown best in FIG. 3, the ends 63 of the arms 60 act as stops that engage the ears 52 of the slider member 48 and retain it in its biased, loaded position. The latch member 58 is pivotally mounted for rotation about a transversely extending generally horizontal axis y—y. Biasing means 62 such as springs or the like (not shown) are provided for urging the arms 60 upwardly to their stopping position. The latch member 58 also includes a pair of spaced apart upwardly extending post sections 64. These post sections 64 extend upwardly to either side of the platform assembly and are interconnected at their upper ends by a transversely extending crosspiece 66 (shown at the top of FIG. 2B). Downward pressure on the crosspiece 66 moves the associated portion of the latch member 58 downward about the transverse pivot y—y. This thus moves the ends 63 of the arms 60 below the ears 52 of the slider 48, to allow the slider to be propelled forwardly as shown in FIG. 4. As shown in FIGS. 2A, 3 and 4, a vertically movable rod 68 is mounted along the central axis of the unit. The crosspiece 66 passes underneath the lower end 70 of the rod 68. Thus, when the rod 68 is depressed, the lower end 70 engages the crosspiece 66 and moves it downward to release the slider 48. The ends 63 of the latch arms 60 may be provided with cam surfaces 74 that are shaped and positioned to engage cam surfaces 76 on the ears 52 of the slider to allow re-engagement of the ends with the ears when the slider 48 is pushed rearwardly at reloading.

The vertical movable release rod 68 extends through a mating vertically extending opening through the upper shaft portion 46. The upper end 78 of the rod 68 extends upwardly into a recess 79 in a knob 80 at the upper end of the upper shaft portion 46. The rod 68 may be manually depressed by pushing down on the rod upper end 78 to release the slider 48.

The upper end of the upper shaft portion 46 extends above the top of the upper mountain section 24 and is provided with the grippable knob or handle 80. As noted above, the upper shaft portion 46 is locked to the platform assembly for common rotation. In this way, rotating the handle 80 will rotate the platform and the projecting mechanism, and thereby aim the mechanism.

Within the upper mountain section 24 there is an upper support structure 82. As shown best in FIG. 2A, the structure 82 includes a top portion in the form of an inverted cup 81 and a bottom portion in the shape of a transverse yoke or strap 83. Among other things, the upper support structure 82 provides bearings for the upper shaft portion 46. Mounted on the top portion 81 of the upper support structure 82 is an indexing mechanism 84 which facilitates positioning the forward direction of the platform at one of the doorways. More particularly, a notched wheel 86 is fixed for common rotation on the upper shaft portion 46. The wheel 86 has four equally spaced angled notches 88 around its outer periphery. The wheel 86 is disposed in the top portion 81. Mounted on the top portion 81 adjacent to the wheel 86 is a finger mechanism 90 which provides an angled finger 92 for engaging the notches 88 in the wheel 86. The finger 92 and the notches 88 are proportioned, arranged and configured in a way known in the art to allow rotation of the wheel in one direction but not the other.

The finger 92 may be moved vertically down out of the way of the wheel 86, to allow free clear rotation of the wheel, the shaft portions 44, 46 and the platform assembly. This allows the child-user to spin the knob 80 to allow the projecting mechanism to assume a random position free of the restraint of the indexing means. The finger 92 may then be allowed to move vertically back up to where it can re-engage a notch 88 in the wheel 86. The wheel 86 may then be rotated (by means of the knob) until the finger 92 actually re-engages with a notch 88. This insures that the projecting mechanism is aimed at one of the doorways.

In the illustrated structure, the finger mechanism 90 includes a housing 94 with a generally vertical slot 96 through which the finger 92 extends radially inwardly. The finger 92 may be biased upwardly for movement along the vertical slot 96 as by means of a leaf spring 98, to a position at the same level as the wheel 86. In this position of the finger 92, it will cooperation with the notches 88 of the wheel 86 to provide the indexing. The finger 92 may be provided with an upward extension 100. The upper end of extension 100 passes upwardly through a suitable aligned opening 101 in the top of the upper mountain section to provide a manually externally operable release button 103. The user may then depress the button 103 to disengage the finger 92 from the notches 88 and permit freewheeling of the shaft portions and the platform assembly.

In the illustrated structure, the noise maker 37 is actuated after an apparently random amount of rotation of the knob 80. To make this arrangement work, in the play of the game the knob 80 is rotated a notch (90°) each time a new player moves, or each time a play piece moves to a new position along the pathway. Either will work, since the precise timing is not important; what is required is having some movement of the handle that coordinates with the ongoing play of the game that will result in an apparently random going off of the sound maker.

As shown in FIG. 5, the noise-making mechanism 37 comprises a pod or container 106 of a generally rigid material which contains a plurality of discrete elements 108. When the pod is rapidly reciprocated, a sound simulating the "rattle" sound of a rattlesnake is produced. The pod 106 is mounted on a spring arm 110 mounted on the adjacent housing structure 21. The pod has an outwardly extending tab portion 112. The noise maker mechanism 37 also includes a gearwheel 114 that is rotatably mounted on the upper support structure 82 adjacent the upper shaft portion 46. The gearwheel 114 has an upwardly extending bearing 113 that is rotatably mounted on a depending shaft stub 115 supported by the top portion 81. A drive gear 116 is fixed to the upper shaft portion 46 for common rotation with the shaft portion. The drive gear 116 meshes with the gearwheel 114; as the upper shaft portion 46 rotates, the noise maker gearwheel 114 also rotates. The gearwheel 114 carries a depending pin 118 adjacent its outer periphery. As shown best in FIG. 5, the pin 118 is positioned and arranged so that as the gearwheel 114 rotates, the pin will engage the tab 112 on the spring arm 110. As the gearwheel 114 continues to rotate, the spring arm 110 will be deflected. When there is sufficient rotation of the gearwheel 114, the pin 118 and the tab 112 will disengage, to allow the pod 106 to rapidly reciprocate at the end of the spring arm 110, to provide the "rattling" sound.

In the play of the game, each of four child players position herself or himself in front of one of the doorways 32. The release button 103 is depressed and the knob 80 is rapidly rotated and allowed to freely come to a halt. This causes rotation of the projecting mechanism 36 and its coming to rest at a position concealed from the players. The release button 103 is then allowed to move upwardly to re-engage the indexing mechanism. The knob 80 is then turned sufficiently to allow the projecting mechanism to aim at one of the doorways. Which doorway remains unknown to the players. The rotation of the knob has also resulted in rotation of the noisemaker gearwheel 114 to position the pin 118 at an apparently random position unknown to the players. The play may then proceed, as by the players taking turns moving their pieces along from position to position along the spiral pathway. The knob 80 may be turned as the play pieces are moved, until the pin 118 releases from the tab 112 and the "rattle" sound of the rattlesnake is heard. At this point the players may have a chance to react. For example, players may elect to move their play pieces rearwardly to a "safe" position to avoid the impact of being the one "attacked" by the toy rattlesnake.

Next, the upper end 78 of the rod 68 is manually depressed to fire or project the toy snake 33 out through one of the doorways 32. Again, according to the particular rules of the game, the player from whose doorway the rattlesnake emerged may be penalized. For example, the player may have to move his or her play piece back along the pathway a predetermined number of positions or to a designated rearward location, etc.

The toy rattlesnake is then reinserted through the doorway 32 from which it emerged. This pushes the slider 48 inwardly and re-engages the latch arm stops 63 with the ears 52 on the slider to reset the projecting mechanism 36. Then the process is repeated, i.e. the release button 103 is depressed, the knob 80 is twirled to put the projecting mechanism into a randomly unknown position (and to randomly reposition the gearwheel 114 and its pin 118 relative to the noisemaker), the indexing mechanism is re-engaged and the projecting mechanism aimed at one of the doorways (still unknown) and the play continues. Thus, the game involves a series of random positionings of the projecting mechanism, playing the game, having the sound maker mechanism go off to provide the rattlesnake noise, players reacting to the "danger", releasing the snake, randomly resetting the position of the projecting mechanism, etc., etc. This can continue until the stated objective of the game is reached, as by one of the players reaching the top of the mountain with his or her play piece.

What is claimed is:

1. A multiple-station surprise action game apparatus comprising:

a base;

a plurality of player stations spaced from each other around the base;

an object-projecting mechanism on the base and capable of projecting an object at any one of said player stations;

means, operatively associated with the object-projecting mechanism, for setting said mechanism on a random or apparently random basis so that the mechanism will project, when the mechanism is activated, an object at only one of said player stations, the identity of said only one player station being concealed from the players;

means, operatively associated with said mechanism, for activating said mechanism to project said object at said only one player station;

indicating means; and means for activating the indicating means after a random or apparently random period of time.

2. The apparatus of claim 1, wherein;

said base is in the form of a housing; and said mechanism is within the housing.

3. The apparatus of claim 2 wherein said mechanism is movable to aim at any one of the player stations, said setting means being operable to aim the mechanism at said only one player station.

4. The apparatus of claim 3 wherein said mechanism is rotatable to aim at the player stations.

5. The apparatus of claim 2 wherein said player stations are in the form of operable doorways which a mechanism-projected object can pass outwardly through.

6. The apparatus of claim 5 wherein said doorways each comprise an open door frame and an associated door pivotally mounted in the door frame.

7. The apparatus of claim 5 wherein there are four generally equally spaced player stations around the base.

8. The apparatus of claim 1 wherein said indicating means comprises a mechanical device.

9. The apparatus of claim 1 wherein said means for activating the indicating means is operatively associated with and controlled by said mechanism setting means.

10. A multiple-station surprise action game apparatus comprising:

a base in the form of a housing;

a plurality of player stations spaced from each other around the base and having the form of operable doorways for outward passage of an object;

an object-projecting mechanism within the housing and capable of projecting an object at and through any one of said player stations;

means, operatively associated with the object-projecting mechanism, for setting said mechanism on a random or apparently random basis so that the mechanism will project, when the mechanism is activated, an object at only one of said player stations, the identity of said only one player station being concealed from the players; and means, operatively associated with said mechanism, for activating said mechansim to project said object at said only one player stations;

wherein said doorways each comprise an open door frame and an associated door pivotally mounted in the door frame said doors being hingedly supported at their upper ends and hung downward therefrom.

11. A multiple-station surprise action game apparatus comprising:

a base having the form of a housing;

a plurality of player stations spaced from each other around the base and having the form of operable doorways for outward passage of an object;

an object-projecting mechanism within the housing and capale of projecting an object at and through any one of said player stations, the orientation of said mechanism in relation to the player stations being concealed from all of the players;

means, operatively associated with the object-projecting mechanism, for manula manipulation by any of the players, while the orientation of said mechanism remains concealed from all of the players, to set said mechanism on a random or apparently random basis so that the mechanism will project, when the mechanism is activated, an object at only one of said player stations; and means, operatively associated with said mechanism, for activating said mechanism to project said object at said only one player station;

wherein said manual-manipulation means include indexing means for controlling the movement of the mechanism to proceed in one direction only and by increments equal to the distance between player stations even though the orientation of said mechanism remains concealed from all of the players.

12. The apparatus of claim 11, further comprising:

indicating means; and means for activating the indicating means automatically in response to movement of the mechanism through a random or apparently random number of said increments.

13. A multiple-station surprise action game apparatus comprising:

a base in the form of a housing;

a plurality of player stations spaced from each other around the base and having the form of operable doorways for outward passage of an object;

an object-projecting mechanism within the housing and capable of projecting an object at and through any one of said player stations;

means, operatively associated with the object-projecting mechanism, for setting said mechanism on a random or apparently random basis so that the mechanism will project, when the mechanism is activated, an object at only one of said player stations, the identity of said only one player station being concealed from the players; and means, operatively associated with said mechanism, for activating said mechanism to project said object at said only one player station;

wherein said setting means include indexing means for controlling the movement of the mechanism to increments equal to the distance between player stations, and also include index release means for releasing the indexing means so that the setting means can move freely for randomly setting the position of the mechanism.

14. A method of carryout a multiplayer surprise action game, comprising the steps of:

a. arranging a plurality of players spaced around an object-projecting mechanism, each player thereby defining a player station, the mechanism being capable of aiming at each of the stations;

b. causing the mechanism to randomly or apparently randomly aim at only one of the stations without revealing which only one station to the players;

c. allowing added time after said aiming for the players to take desired action regarding the game;

d. only then activating the projecting mechanism to project an object at said only one station; and e. taking action in the game based on which station was said only one station.

15. The method of claim 14 further including the step of causing a mechanical timing mechanism to advance in timed coordination with play of the game to eventually activate a mechanical indicating device after a random or apparently random time period.

16. A multiple-station surprise action game apparatus comprising:

a base;

a plurality of player stations spaced from each other around the base;

an object-projecting mechanism supported from the base and capable of projecting an object at any one of said player stations;

means, operatively associated with the object-projecting mechanism, for setting said mechanism on a random or apparently random basis so that the mechanism will project, when the mechanism is activated, an object at only one of said player stations, the identity of said only one player station being concealed from the players; and means, operatively associated with said mechanism, for activating said mechanism to project said object at said only one player station;

wherein said setting means include indexing means for controlling the movement of the mechanism to increments equal to the distance between player stations, and also include index release means for releasing the indexing means so that the setting means can move freely to randomly setting the position of the mechanism.

* * * * *